United States Patent [19]

Herrmann et al.

[11] Patent Number: 4,473,629

[45] Date of Patent: Sep. 25, 1984

[54] ELECTROPHOTOGRAPHIC LIQUID DEVELOPER AND PROCESS FOR ITS PREPARATION

[75] Inventors: Heinz Herrmann; Hans-Joachim Schlosser, both of Wiesbaden, Fed. Rep. of Germany

[73] Assignee: Hoechst Aktiengesellschaft, Frankfurt am Main, Fed. Rep. of Germany

[21] Appl. No.: 372,012

[22] Filed: Apr. 26, 1982

[30] Foreign Application Priority Data

May 9, 1981 [DE] Fed. Rep. of Germany ..... 3118544

[51] Int. Cl.[3] ..... G03G 9/12

[52] U.S. Cl. ..... 430/114; 430/115; 430/116; 430/137

[58] Field of Search ..... 430/117, 106, 114, 115, 430/116, 137; 427/15, 17

[56] References Cited

U.S. PATENT DOCUMENTS

| | | | |
|---|---|---|---|
| 3,909,433 | 9/1975 | Gilliams et al. | 430/116 |
| 3,915,874 | 10/1975 | Machida et al. | 430/116 |
| 3,993,483 | 11/1976 | Maki et al. | 430/115 |
| 4,081,391 | 3/1978 | Tsubuko et al. | 430/116 |
| 4,206,064 | 6/1980 | Kiuchi et al. | 430/106 |

*Primary Examiner*—John E. Kittle
*Assistant Examiner*—John L. Goodrow
*Attorney, Agent, or Firm*—Schwartz, Jeffery, Schwaab, Mack, Blumenthal & Koch

[57] ABSTRACT

A liquid developer containing negatively charged toner particles for developing electrostatic charge images, comprising a carrier liquid having a high electrical resistivity and a low dielectric constant, a pigment or dye constituent, a resinous binder, a charge controller and conventional additives, wherein the pigment or dye constituent is dispersed in a solution of styrene/butadiene copolymer binder in the carrier liquid; and a process for preparing the liquid developer by mixing a dispersion of the pigment or dye constituent in a solution of the copolymer binder in the carrier liquid with a solution of the charge controller in the carrier liquid.

24 Claims, No Drawings

ELECTROPHOTOGRAPHIC LIQUID DEVELOPER AND PROCESS FOR ITS PREPARATION

BACKGROUND OF THE INVENTION

The present invention relates to an electrophotographic liquid developer containing negatively charged toner particles and comprising a carrier liquid having a high electrical resistivity and a low dielectric constant, a pigment or dye constituent, a resinous binder, a charge controller and conventional additives. The invention also relates to a process for preparation of such a liquid developer.

In the field of electrophotography, processes which have found widespread application are generally those in which the toner particles deposited on the electrostatic latent charge image are transferred from the photoconductor layer to a suitable transfer material, such as plain paper, and are fixed thereon. In such procedures, the charge image can be developed using either dry or liquid developers.

Basically, liquid developers comprise insulating carrier liquids in which pigments or dyes, resins, charge controllers and possibly other additives are dispersed or dissolved. In the electric field of the charge image, the charged toner particles are deposited electrophoretically on the charge image. For positive charge images, such as those formed in electrophotographic processes using photoconductive selenium layers, developers containing negatively charged toner particles are required. In order for the transfer from the copying layers to the transfer material to be successful, the toner particles must be larger than non-transferrable toner particles, utilized for developing charge images on zinc oxide/binder layers.

Various liquid developers with negatively charged toner particles are known for use in the toner image transfer process. British Pat. No. 1,374,701 discloses a process in which a pigment is milled or kneaded with a combination of three polymers A, B and C in an aromatic solvent, and the ground material is then dispersed in an insulating carrier liquid in which the polymers are insoluble or only slightly soluble. Polymer A effects good transfer of the toner particles; polymer B ensures high stability of the liquid developer and good fixability on the transfer material, and polymer C controls the electrical charge of the toner particles.

U.S. Pat. No. 3,853,554 discloses liquid developers containing toner particles comprising pigments/dyes, cyclized rubber, polyethylene and a charge controller—in particular, for a negative charge, lecithin—and further resins and waxes. To prepare the liquid developer, the pigments/dyes are initially dispersed in a solution of cyclized rubber and of the further constituents in an aromatic solvent. The dispersion is then diluted with the insulating carrier liquid which does not dissolve the rubber.

U.S. Pat. No. 3,993,483 discloses a liquid developer which is prepared by dispersing pigment in an aromatic solution of two polymeric compounds, after which the dispersion is diluted with the nondissolving insulating carrier liquid. One polymer is a varnish resin, for example a coumarone, phenol or maleate resin, and the other is a polyolefin or an olefin copolymer. To obtain negatively charged toner particles, various controllers, such as carrier liquid-soluble metal salts of organic sulfoacids, are added.

It is also known to prepare liquid developers by distributing the pigments in dispersions of polymers in the insulating aliphatic carrier liquid (so-called organosols or dispersimers) and thereafter effecting dilution. Pigments flushed with resin solutions are preferably used. During the process in which the pigment surface is treated, further polymerization of monomer onto the resin used can be effected. The dispersimers are obtained by a multistage copolymerization and graft polymerization (U.S. Pat. No. 4,081,391) or by dissolution of a resin, which is insoluble in the carrier liquid, in a monomer or mixture of monomers which is capable of forming a soluble polymer, and subsequent polymerization (U.S. Pat. No. 4,104,183). The dispersimers preferably also contain waxes such as polyethylene waxes. Liquid toners of this type can also contain two dispersimers (German Offenlegungsschrift No. 2,936,042). The toner charge is determined by the composition of the dispersimers and of the pigments.

U.S. Pat. No. 4,161,453 discloses preparation of liquid developers by kneading the pigment with a molten copolymer of styrene and allyl alcohol (or an allyl alcohol ester), then grinding the kneaded material, after cooling, to give a dry toner, and finally dispersing the dry toner particles in a carrier liquid which contains the charge controller and soluble acrylic resins.

U.S. Pat. No. 4,243,736 and German patent application No. P 30 11 193 disclose further liquid developers for the toner image transfer process which essentially contain the carrier liquid, pigments and N-vinylpyrrolidone-containing copolymers which are soluble in the carrier liquid and which simultaneously act as the dispersant or fixer and as the charge controller. The polymers can be copolymers, terpolymers or graft copolymers.

Although in many cases the known liquid developers which are suitable for the toner image transfer process give good copies and large numbers of copies, they have various deficiencies. Some of the liquid developers contain physiologically unacceptable aromatic solvents. During the copying process, these solvents pass, together with the carrier liquid, into the air surrounding the copying machine. In addition, the aromatic compounds also adversely affect the odor of the developers. Depending on the distribution of the aromatic solvents between the insulating carrier liquid and the polymer particles, they additionally increase to a greater or lesser extent the tackiness of the toner particles. This is disadvantageous for the stability of the liquid developer, since tacky particles collect together more readily to give undesirable agglomerates. Other known liquid developers have complicated compositions. In addition to the dispersimers which often must be obtained by a multi-stage reaction, they also frequently contain pigments which are pre-wetted by the flushing process. Because of the complicated and time-consuming nature of the preparation of the starting materials and of the production processes, these developers are relatively expensive. This also applies to liquid developers obtained by dispersing a dry toner in a carrier liquid. On the other hand, the known liquid developers which are of simpler composition containing negatively charged toner particles for the toner image transfer process exhibit deficiencies when used for a relatively long time in copying machines. They soil the machines to a relatively great extent, thus giving rise to breakdowns during the copying process and to a reduced quality of the copies.

SUMMARY OF THE INVENTION

Accordingly, it is the object of the present invention to provide an improved liquid developer containing negatively charged toner particles for developing a charge image.

A further object of the present invention is to provide a liquid developer which is physiologically unobjectionable.

Another object of the present invention is to provide a liquid developer which is free of aromatic solvents.

It is also an object of the present invention to provide a liquid developer which can yield large numbers of high quality, wipe-resistant copies.

Additionally it is an object of the present invention to provide a liquid developer with improved stability.

A still further object of the present invention is to provide a liquid developer in which the toner particles have a reduced tendency toward tackiness and agglomeration.

Yet another object of the present invention is to provide a high quality liquid developer having a relatively simple composition.

An additional object of the invention is to provide a simple liquid developer with a lesser tendency to soil copier machines in which it is used.

It is also an object of the invention to provide a simple process for the preparation of such a liquid developer, using, as far as possible, commercially available raw materials.

These and other objects of the invention are achieved by providing a liquid developer containing negatively charged toner particles for developing electrostatic charge images and comprising a carrier liquid having a high electrical resistivity and a low dielectric constant, a pigment or dye constituent, a resinous binder, and a charge controller, wherein the pigment or dye constituent is dispersed in a solution of a styrene/butadiene copolymer resinous binder in the carrier liquid.

Preferably the styrene/butadiene copolymer is a random styrene/butadiene copolymer obtained by solution polymerization. A copolymer containing a proportion of from about 20 to about 40 weight percent styrene is particularly preferred, most preferably one which contains from about 20 to about 25 weight percent styrene.

The liquid developer containing negatively charged toner particles is prepared according to the invention from a carrier liquid having a high electrical resistivity and a low dielectric constant, a pigment or dye constituent, a resinous binder, a charge controller and conventional additives. Preparation of the liquid developer is effected by dissolving a styrene/butadiene copolymer, as the resinous binder, in a portion of the carrier liquid, grinding and dispersing the pigment or dye constituent in this solution, intensively mixing the dispersion with a solution of the negative charge-producing charge controller in another portion of carrier liquid, and then diluting the resulting toner concentrate with carrier liquid.

By this means, it is possible to provide a liquid developer which is physiologically acceptable since it does not contain any aromatic solvent constituents, is of high stability, gives a large number of copies of excellent quality without soiling the copying machine so as to interrupt its function, and can be prepared by a simple process.

DETAILED DESCRIPTION OF PREFERRED EMBODIMENTS

Suitable carrier liquids having a high electrical resistivity and a low dielectric constant include paraffinic aliphatic hydrocarbons such as n-hexane, ligroin, n-heptane, n-pentane, isododecane and isooctane, and also halogen derivatives of paraffinic aliphatic hydrocarbons such as carbon tetrachloride and perchloroethylene. All of these substances possess a high insulating power (i.e. a specific electrical resistivity greater than $10^9$ ohm cm) and a low dielectric constant (i.e. a dielectric constant less than 3). The commercially available aliphatic hydrocarbons "Isopar® E, G, L, H or K" from Esso-Chemie, Hamburg, are particularly suitable. These substances can be used alone or in combination.

Styrene/butadiene copolymers soluble in the carrier liquid are preferably obtained by solution polymerization. It has been found that copolymers which have a random distribution are superior to block copolymers. Copolymers containing from about 20 to about 40, preferably from about 20 to about 25 weight percent styrene have proved very suitable. Useful styrene/butadiene copolymers are commercially available, for example as the Solprene® types from Phillips Petroleum Corp., USA.

Pigments or dyes useful in the invention are also known. As a rule carbon blacks, such as channel black, furnace black or lamp black (C.I. No. of all varieties of carbon black 77 266) are employed in preparing black developers. Acidic carbon blacks with a mean particle size of 20 to 30 $\mu$m and a surface area of 80 to 200 $m^2/g$ (BET) are preferred. Organic pigments, such as Phthalocyanine Blue (C.I. No. 74 160), Phthalocyanine Green (C.I. No. 74 260 or 42 040), Sky Blue (C.I. No. 42 780), Rhodamine (C.I. No. 45 170), Malachite Green (C.I. No. 42 000), Methyl Violet (C.I. No. 42 535), Peacock Blue (C.I. No. 42 090), Naphthol Green B (C.I. No. 10 020), Naphthol Green Y (C.I. No. 10 006), Naphthol Yellow S (C.I. No. 10 316), Permanent Red 4R (C.I. No. 12 370), Brilliant Fast Pink (C.I. No. 15 865 or 16 105), Hansa Yellow (C.I. No. 11 725), Benzidine Yellow (C.I. No. 21 100), Lithol Red (C.I. No. 15 630), Lake Red (C.I. No. 15 585) and Lake Red D (C.I. No. 15 500), Brilliant Carmine 6B (C.I. No. 15 850), Permanent Red F5R (C.I. No. 12 335) and Pigment Pink 3B (C.I. No. 16 015), are also suitable. Inorganic pigments, for example Berlin Blue (C.I. No. Pigment Blue 27), are also useful.

A pigment or pigment mixture is preferably used, according to the invention, in the preparation of the toner. The reason for this lies in the fact that pigments exhibit superior fade-resistance compared to dyes. In addition, by using pigments, image copies of high contrast in comparison with those obtained with dye-containing toners can be produced.

The charge controllers used according to the invention are materials which have previously been used for this purpose. It is also possible to use several charge controllers simultaneously. The following compounds can be used to produce negatively charged particles: phospholipoids such as lecithin, kephalin and the like; metal salts of alkylbenzenesulfonic acids having alkyl groups with 8 to 20 carbon atoms (the metal being Na, Ca, Mg, K, Al, Zn or Ba); metal salts of dialkylsulfosuccinic acids having alkyl groups with 8 to 20 carbon atoms (with Na, Ca, Mg, K, Al, Zn or Ba as the metal); and metal salts of dialkylnaphthalenesulfonic acids, the alkyl groups of which have 8 to 20 carbon atoms (with Na, Ca, Mg, K, Al, Zn or Ba as the metal). The charge controller or the mixture of charge controllers is employed in solution.

To produce a negative charge on the pigment particles, N-vinylpyrrolidone-containing polymers soluble in the carrier liquid are preferably used. These may be copolymers of a solubility-promoting methacrylic acid ester having a long alkyl radical and from 10 to 40 weight percent of N-vinylpyrrolid-2-one, or graft copolymers obtained by polymerizing from 2.5 to 10 weight percent N-vinylpyrrolid-2-one onto soluble homopolymers or copolymers of methacrylic acid esters.

The term "conventional additives" is understood to refer to added materials which influence diverse toner properties and which may or may not be present in any given case. Such additives influence the charge level, the sedimentation characteristics, the life span, the redispersibility of agglomerates, the transferrability, and the wiperesistance of the liquid developer or of the toner particles on the copying paper. Suitable additives include conventional substances, such as waxes, particularly polyethylene waxes, paraffin waxes and chloroparaffin waxes. A wax or polyethylene with a softening point in the range from 60° to 130° C. can be used as the wax or polyethylene according to the invention. The aforementioned waxes or polyethylenes possess properties which—in respect of the specific mass—are similar to those of the carrier liquid used. Polymers which are soluble in aliphatic compounds, such as polyvinyl alkyl ethers, polisobutylene, polyvinyl stearate and polyacrylates or polymethacrylates with a higher alcohol radical; or plasticizers, such as dialkyl phthalates, are also suitable additives.

The mixing ratios of the individual components may vary within wide limits. In general from 0.2 to 0.5, preferably from 0.25 to 0.4, part by weight of the styrene/butadiene copolymer, from 0.02 to 1 part by weight of the charge controller and from 0 to 0.8 part by weight of the additive are used per part by weight of the pigment. If an N-vinylpyrrolidone graft copolymer is used as the charge controller, preferably from 0.5 to 0.8 part by weight is employed per part by weight of the pigment. If a chloroparaffin additive is included, preferably from 0.01 to 0.1 part by weight is used per part by weight of the pigment.

In preparing the liquid developer according to the invention, the pigments must always first be dispersed in the styrene/butadiene copolymer solution which is free from charge controllers. The dissolved charge controller is added only after the dispersion process. It was completely surprising that liquid developers having the advantages described above could be provided by the process according to the invention.

The styrene/butadiene copolymers can be dissolved in the solvent used as the carrier liquid at room temperature or at an elevated temperature. The concentration of the solution may vary within wide limits. Three-roll mills, attrition mills, ball mills, stirred ball mills, and the like are suitable for dispersing the pigments in the polymer solution. The conventional additives can be added to the solution of the styrene/butadiene copolymer and/or to the solution of the charge controller. Preferably, the styrene/butadiene copolymer solution contains the additive.

The following, non-limiting examples illustrate the invention in more detail.

EXAMPLE 1

Twenty-four g of a styrene/butadiene (25/75) copolymer having a random distribution, obtained by solution polymerization, and having a density of 0.933 g was dissolved while stirring at room temperature in 400 g of an aliphatic hydrocarbon having a boiling range of 174°–189° C. The copolymer had a viscosity of 56° at 100° C. (ML-4, Mooney viscosity according to ASTM D 926 67). 60 g of carbon black (channel black) having a mean particle size of 25 nm and a BET surface area of 180 $m^2/g$ were introduced into the solution, and the mixture was then ground in a stirred ball mill, while warming to 80° C. After 3 hours the ground material was cooled to about 40° C., and a further 750 g of the aliphatic hydrocarbon were stirred in.

Five hundred g of the resulting pigment dispersion were intensively mixed with a solution of 1 g of lecithin in 500 g of the aliphatic hydrocarbon using a laboratory dissolver. A toner concentrate containing negatively charged toner particles was obtained.

To prepare a ready-to-use liquid developer, 1 part by weight of the toner concentrate was diluted with 9 parts by weight of an aliphatic hydrocarbon having boiling range of 158°–177° C.

EXAMPLE 2

Seventy g of channel black having a particle size of 25 nm and a surface area (BET) of 180 $m^2/g$ and 10 g of a polyethylene wax having an average molecular weight of 1,500 were introduced into a styrene/butadiene copolymer solution obtained according to Example 1, and the mixture was ground as described in Example 1. The ground material was diluted with 750 g of aliphatic hydrocarbon while still in the ball mill.

Five hundred g of the prepared pigment dispersion were mixed in a stirrer with a solution of 2.5 g dioctyl sodium sulfosuccinate in 450 g of the aliphatic hydrocarbon.

After the resulting toner concentrate had been diluted with nine times its weight of an aliphatic hydrocarbon having boiling range of 158°–177° C., a negatively charged liquid developer for the toner image transfer process was obtained.

EXAMPLE 3

Twenty-five g of a random styrene/butadiene (25/75) copolymer obtained by solution polymerization and having a Mooney viscosity of 33 (ML-4) at 100° C. and a density of 0.933 were dissolved, at 80° C., together with 30 g of a polyethylene wax having an average molecular weight of 1,500 in 450 g of an aliphatic hydrocarbon having a boiling range of 174°–189° C. When the solution was cooled, the wax flocculated. 60 g of carbon black, as described in Example 1, and 15 g of copper phthalocyanine powder were added, and the mixture was ground according to the procedure of Example 1. The ground material was diluted with 750 g of the hydrocarbon while still in the ball mill.

Five hundred g of the pigment dispersion were stirred intensively with a mixture of 500 g of the aliphatic hydrocarbon and 40 g of a commercial, approx. 40% strength solution in mineral oil, of a dodecyl methacrylate/methyl methacrylate (76/20) copolymer which had an average molecular weight of approximately 450,000 and onto which 4 percent by weight of N-vinylpyrrolid-2-one had been grafted.

After the mixture had been diluted with the aliphatic hydrocarbon (boiling range 158°–177° C.) in a weight ratio of 1:9, a good negative developer for the transfer process was obtained.

EXAMPLE 4

Twenty-six g of the styrene/butadiene copolymer described in Example 3 and 15 g of a polyethylene wax having an average molecular weight of 1,500 were dissolved, while warm, in 500 g of an aliphatic hydrocarbon (boiling range 174°–189° C.). 60 g of a carbon black and 20 g of copper phthalocyanine were introduced into the solution, and the mixture was ground and diluted with 750 g of the aliphatic hydrocarbon in a Molinex PE 5 stirred ball mill according to the procedure of Example 3.

Five hundred g of the resulting pigment dispersion were stirred intensively, with the aid of a dissolver, with a mixture of 500 g of the aliphatic hydrocarbon, 60 g of a commercial, approx. 30% strength solution in medium mineral oil, of a dodecyl methacrylate/methyl methacrylate (76/20) copolymer having an average molecular weight of approximately 800,000, and onto which approximately 4% by weight of N-vinylpyrrolid-2-one had been grafted, and 10 g of a saturated solution of a solid chlorinated paraffin with a chlorine proportion of 70% in the aliphatic hydrocarbon.

By diluting the resulting toner concentrate with nine times its weight of an aliphatic hydrocarbon (boiling range 158°–177° C.), a transferrable liquid developer containing negatively charged toner particles was obtained. The developer liquid possessed a high life span in conventional copying machines equipped with selenium photoconductor drums, gave copies of good quality, and did not soil the machines so as to interrupt their function.

The foregoing description has been set forth merely to illustrate the invention and is not intended to be limiting. Since modifications of the described embodiments incorporating the spirit and substance of the invention may occur to persons skilled in the art, the scope of the invention should be limited solely with respect to the appended claims and equivalents.

We claim:

1. An electrophotographic liquid developer comprising a carrier liquid of high electric resistivity and low dielectric constant, a toner comprising negatively charged toner particles of a pigment or dye constituent, a styrene/butadiene copolymer resinous binder, and a negative charge-producing charge controller, wherein the particles are dispersed in a solution of the styrene/butadiene copolymer binder in the carrier liquid.

2. A liquid developer according to claim 1, wherein said styrene/butadiene copolymer is obtained by solution polymerization.

3. A liquid developer according to claim 1, wherein said styrene/butadiene copolymer has a random distribution.

4. A liquid developer according to claim 1, 2 or 3, wherein said styrene/butadiene copolymer comprises from about 20 to about 40 weight percent styrene.

5. A liquid developer according to claim 4, wherein said styrene/butadiene copolymer comprises from about 20 to about 25 weight percent styrene.

6. A liquid developer according to claim 1, wherein said carrier liquid has a specific electrical resistivity greater than $10^9$ ohms cm and a dielectric constant less than 3.

7. A liquid developer according to claim 6, wherein said carrier liquid is selected from the group consisting of paraffinic aliphatic hydrocarbons, halogenated paraffinic aliphatic hydrocarbons, and mixtures thereof.

8. A liquid developer according to claim 1, wherein said pigment or dye constituent is a pigment.

9. A liquid developer according to claim 1, 2, or 3, wherein said charge controller comprises an N-vinylpyrrolidone-containing polymer.

10. A liquid developer according to claim 9, wherein said N-vinylpyrrolidone-containing polymer comprises a copolymer of from 60 to 90 weight percent methacrylic acid ester and from 10 to 40 weight percent N-vinylpyrrolid-2-one.

11. A liquid developer according to claim 9, wherein said N-vinylpyrrolidone-containing polymer comprises a soluble homopolymer or copolymer of a methacrylic acid ester onto which from 2.5 to 10 weight percent N-vinylpyrrolid-2-one has been grafted.

12. A liquid developer according to claim 1, further comprising at least one conventional additive selected from the group consisting of charging regulators, sedimentation regulators, life span regulators, agglomerate redispersing agents, transferrability regulators, wipe-resistance agents and plasticizers.

13. A liquid developer according to claim 12, wherein said additive is selected from the group consisting of polyethylene waxes, paraffin waxes, and chloroparaffin waxes having a softening point in the range from 60° to 130° C.

14. A liquid developer according to claim 1, wherein said pigment or dye constituent is carbon black.

15. A process for preparing a liquid developer containing negatively charged toner particles for the development of electrostatic charge images, said process comprising dissolving a styrene/butadiene copolymer resin binder in a first portion of a carrier liquid having a high electrical resistivity and a low dielectric constant;

dispersing a pigment or dye constituent in the solution of resin binder in the carrier liquid;

mixing the resulting pigment or dye dispersion with a solution of a negative charge-producing charge controller in a second portion of said carrier liquid to produce a toner concentrate; and diluting said toner concentrate with additional carrier liquid.

16. A process according to claim 15, further comprising incorporating at least one conventional additive selected from the group consisting of charging regulators, sedimentation regulators, life span regulators, agglomerate redispersing agents, transferrability regulators, wipe-resistance agents and plasticizers in at least one of said solution of styrene/butadiene copolymer resin binder in the carrier liquid and said solution of charge controller in the carrier liquid.

17. A process according to claim 16, wherein said additive is incorporated into the styrene/butadiene copolymer resin binder solution.

18. A process according to claim 15, wherein a styrene/butadiene copolymer which has been obtained by solution polymerization is used.

19. A process according to claim 15, wherein a styrene/butadiene copolymer which has a random distribution is used.

20. A process according to claim 15, 18, or 19, wherein a styrene/butadiene copolymer comprising from about 20 to about 40 weight percent styrene is used.

21. A process according to claim 20, wherein said styrene/butadiene copolymer comprises from about 20 to about 25 weight percent styrene.

22. A process according to claim 15, wherein at least one N-vinylpyrrolidone-containing polymer is used as the negative charge-producing charge controller.

23. A process according to claim 22, wherein said N-vinylpyrrolidone-containing polymer comprises a copolymer of from 60 to 90 weight percent methacrylic acid ester and from 10 to 40 weight percent N-vinylpyrrolid-2-one.

24. A process according to claim 22, wherein said N-vinylpyrrolidone-containing polymer comprises a soluble homopolymer or copolymer of a methacrylic acid ester onto which from 2.5 to 10 weight percent N-vinylpyrrolid-2-one has been grafted.

* * * * *